US010371398B2

(12) United States Patent
Buff et al.

(10) Patent No.: US 10,371,398 B2
(45) Date of Patent: Aug. 6, 2019

(54) METHOD AND DEVICE FOR AIR-CONDITIONING A ROOM

(71) Applicant: Fraunhofer-Gesellschaft zur Förderung der angewandten Forschung e.V., Munich (DE)

(72) Inventors: Alexander Buff, Rosenheim (DE); Sophie Lierschof, Rosenheim (DE)

(73) Assignee: FRAUNHOFER-GESELLSCHAFT ZUR FÖRDERUNG DER ANGEWANDTEN FORSCHUNG E.V., Munich (DE)

( * ) Notice: Subject to any disclaimer, the term of this patent is extended or adjusted under 35 U.S.C. 154(b) by 0 days.

(21) Appl. No.: 15/738,952

(22) PCT Filed: Jun. 21, 2016

(86) PCT No.: PCT/EP2016/064268
§ 371 (c)(1),
(2) Date: Dec. 21, 2017

(87) PCT Pub. No.: WO2016/207141
PCT Pub. Date: Dec. 29, 2016

(65) Prior Publication Data

US 2018/0172296 A1 Jun. 21, 2018

(30) Foreign Application Priority Data

Jun. 22, 2015 (DE) ..... 10 2015 211 473

(51) Int. Cl.
*F28F 9/02* (2006.01)
*F24F 5/00* (2006.01)
*F24F 13/22* (2006.01)

(52) U.S. Cl.
CPC ..... *F24F 5/0089* (2013.01); *F24F 13/22* (2013.01); *F24F 2013/221* (2013.01)

(58) Field of Classification Search
CPC ..... F24F 3/1417; F24F 5/0089; F24F 13/22; F24F 2013/221; B01D 53/261
(Continued)

(56) References Cited

U.S. PATENT DOCUMENTS 3,403,723 A * 10/1968 Meckler ..... F24F 3/1417 165/210
5,147,420 A * 9/1992 Claesson ..... B01D 53/261 95/113

FOREIGN PATENT DOCUMENTS

DE 20 2008 014 419 U1 1/2009
DE 10 2008 053 192 A1 4/2010
(Continued)

OTHER PUBLICATIONS

M. Hanif et al., "Potential energy savings by radiative cooling system for a building in tropical climate," Renewable and Sustainable Energy Reviews, dated Feb. 6, 2014, pp. 642-650, vol. 32, published by Elsevier, Amsterdam, The Netherlands.
(Continued)

*Primary Examiner* — Davis D Hwu
(74) *Attorney, Agent, or Firm* — Brinks Gilson & Lione

(57) ABSTRACT

A device for air-conditioning a room may be provided comprising at least one heat sink having at least one boundary surface facing the room, which can be brought to a temperature that is reduced in relation to the heat load, wherein at least one surface element is arranged between the boundary surface and the room, said surface element being at least partially permeable to heat radiation. A method may be provided for air-conditioning a room comprising at least one heat sink having at least one boundary surface facing the room, which is brought to a temperature that is reduced in relation to the heat load, wherein at least one surface element is arranged between the boundary surface and the room, said
(Continued)

surface element being at least partially permeable to heat radiation.

16 Claims, 10 Drawing Sheets

(58) Field of Classification Search
USPC ..... 165/175
See application file for complete search history.

(56) References Cited

FOREIGN PATENT DOCUMENTS

| | | | |
|---|---|---|---|
| DE | 10 2010 003 462 | A1 | 10/2011 |
| DE | 10 2013 019 741 | A1 | 6/2015 |
| EP | 1 489 241 | A1 | 12/2014 |
| JP | H06-323 577 | A | 11/1994 |
| JP | H09-273776 | A | 10/1997 |
| JP | H10-205 833 | A | 8/1998 |
| JP | H10-220 825 | A | 8/1998 |
| JP | 2001355894 | A | 12/2001 |
| JP | 2007132557 | A | 5/2007 |

OTHER PUBLICATIONS

Alfonso Oliva, "BSRIA in the US and AC trends," BSRIA WMI, dated Feb. 2014, pp. 1-19, published online by LinkedIn.
"Klimaanlage," with English translation, Wikipedia, German version dated Jan. 12, 2015, pp. 1-11, published online at de.wikipedia.org by Wikipedia.
Dr. Gunnar Grün, "Kriterien des nachhaltigen Bauens zur Bewertung des thermischen Raumklimas—Weiterentwicklung des Bewertungswerkzeugs und Umsetzung in die Praxis," with English translation, dated Jun. 25, 2013, IBP Report 023/2013/296, pp. 1-100, Fraunhofer-Institut für Bauphysik, Stuttgart, Germany.
Klaus-Dieter Gruner, "Principles of Non-Contact Temperature Measurement," Theory 55514 Eng Rev. B Lr, dated Dec. 2003, pp. 1-32, published by Raytek GmbH, Berlin, Germany.
Peter von Böckh and Thomas Wetzel, "Wärmeübertragung," with English translation, dated 2014, pp. 1-312, 5th Edition, ISBN 978-3-642-37731-0, published by Springer Vieweg, Berlin, Germany.
Dirk Bohne, "Technischer Ausbau von Gebäuden. Und nachhaltige Gebäudentechnik," with English translation, dated Jun. 2014, pp. 1-599, 10th Edition, ISBN 978-3-8348-2253-6, published by Springer Vieweg, Wiesbaden, Germany.
"Air-Conditioning Office Buildings (VDI ventilation code of practice," VDI (short for Organization of German Engineers) Guidelines, dated Mar. 2009, pp. 1-40, VDI 3804, German with English translation, published by Beuth Verlag GmbH, Berlin, Germany.
"Ergonomics of the thermal environment—Analytical determination and interpretation of thermal comfort using calculation of the PMV and PPD indices and local thermal comfort criteria," ISO 7730, ISO 7730:2005(E), dated Nov. 15, 2005, pp. 1-52, 3rd Edition, published by ISO, Geneva, Switzerland.
Jianlei Niu, "Modelling of Cooled-ceiling Air-conditioning Systems," Faculty of Mechanical Engineering and Marine Technology, ISBN 90-370-0105-X, dated 1994, pp. 1-173, Delft University of Technology, Netherlands.
Jianlei Niu et al., "Energy savings potential of chilled-ceiling combined with desiccant cooling in hot and humid climates," Energy and Buildings 34, dated May 29, 2000, pp. 487-495, Department of Building Services Engineering, The Hong Kong Polytechnic University, Hong Kong, China.
Sam C. M. Hui et al., "Thermal Comfort and Energy Performance of Chilled Ceiling Systems," Proceedings of the Fujian-Hong Kong Joint Symposium 2012, dated Jun. 2012, pp. 36-48, Department of Mechanical Engineering, The University of Hong Kong, Fuzhou, China.
Gaoming Ge et al., "Neural network based prediction method for preventing condensation in chilled ceiling systems," Energy and Buildings 45, dated 2012, pp. 290-298, Published by Elsevier, Department of Building Services Engineering, The Hong Kong Polytechnic University, Hong Kong, China.
Corina Stetiu, "Energy and peak power savings potential of radiant cooling systems in US commercial buildings," Energy and Buildings 30, dated 1999, pp. 127-138, Lawrence Berkeley National Laboratory, California, US.
"Remote Sensing," dated Mar. 3, 2015, pp. 1, Published by The Earth Observatory, Retrieved at http://earthobservatory.nasa.gov/Features/RemoteSensing/remote_04.php.
"The Ultimate Infrared Handbook for R&D Professionals—A Resource Guide for Using Infrared in the Research and Development Industry," dated 2017, Published by FLIR, pp. 1-39, Wilsonville, Oregon.
Ashfaque Ahmed Chowdhury et al., "Low Energy Cooling Technologies for Sub-Tropical/Warm Humid Climate Building Systems," dated 2017, pp. 1-9, Academia.edu, San Francisco, CA.
Nipaporn Nutprasert, "Radiant Cooling with Dehumidified Air Ventilation for Thermal Comfort in Buildings in Tropical Climate," Energy Procedia 52, dated 2014, pp. 250-259, Joint Graduate School of Energy and Environment, King Mongkut's University of Technology, Bangkok, Thailand.
Aaron Patrick Boranian et al., "Building Energy Efficiency R&D Roadmap," dated Jul. 29, 2014, pp. 1-45, Building and Construction Authority, National Climate Change Secretariat, Singapore, Malaysia.
R. N. Morse, "Radiant Cooling," Architectural Science Review, 6:2, ISSN: 0003-8628, dated 1963, pp. 50-53, Retrieved at http://dx.doi.org/10.1080/00038628.1963.9696068.

* cited by examiner

METHOD AND DEVICE FOR AIR-CONDITIONING A ROOM

CROSS-REFERENCE TO RELATED APPLICATIONS

This application is a 371 nationalization of international patent application PCT/EP2016/064268 filed Jun. 21, 2016, the entire contents of which are hereby incorporated by reference, which in turn claims priority under 35 USC § 119 to German patent application DE 10 2015 211 473.2 filed on Jun. 22, 2015.

DETAILED DESCRIPTION

Figure 1:
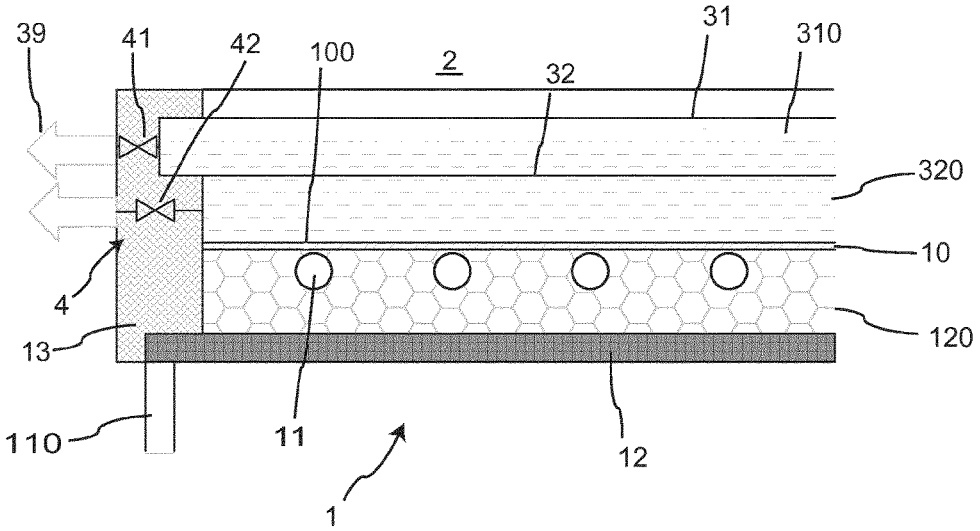
FIG. 1 shows a cross-section through a first embodiment of the device according to the invention for air-conditioning.

The invention relates to a device and a method for air-conditioning a room, in which thermal energy from the room is absorbed by means of at least one heat sink, which has at least one boundary surface facing the room. For this purpose, the boundary surface is brought to a temperature that is reduced in relation to a heat load. Devices and methods of the above-mentioned type are also known under the terms of thermal component activation or cooling ceiling.

S. C. M. Hui and J. Y. C. Leung: Thermal comfort and energy performance of chilled ceiling systems, Proceedings of the Fuyian Hong Kong Joint Symposium 2012, Fuzhou, 36-48, discloses an above-mentioned device. This known device cools a component of a building by a pipe grid in such a way that the component can absorb heat from the room air or from heat loads in the room, thus influencing the indoor climate.

However, this known device has the drawback that the boundary surface which is in direct contact with the room air cannot be cooled below the limit temperature at which condensation starts. This limit temperature is the higher, the higher the relative humidity is. Therefore, in particular in a humid tropical climate this leads to a relatively narrow temperature spread without moisture precipitating on the thermally activated component, which has a negative effect on the room climate or causes structural damage. The effect of the device known per se is therefore insufficient under hot and humid climate conditions.

Proceeding from the prior art, the object of the invention is thus to provide a method and a device for air-conditioning a room, which, on the one hand, is energy-efficient and, on the other hand, has a good cooling effect even in humid climate conditions.

The invention proposes a device for air-conditioning a room, which has at least one heat sink. The heat sink has at least one boundary surface facing the room. For the purposes of the present description, the boundary surface faces the room when heat radiation from at least one heat load in the room can reach the boundary surface directly or via at least one reflection surface.

In some embodiments of the invention, the heat sink can be part of a building, in particular a ceiling or wall built as a solid construction. In other embodiments of the invention, the heat sink can be designed as a plate heat exchanger, capillary tube mat, cooling plate or radiator and can be introduced into the room as a separate component. For example, the heat sink can be made as a ceiling panel or a wall panel. In other embodiments of the invention, the heat sink can be designed as a creative room element or part of the furniture and e.g. be integrated in a lighting device or a piece of furniture. In other embodiments of the invention, the heat sink can be part of a vehicle, of an aircraft or of a ship, or can be mounted as a separate component in the passenger compartment to improve the thermal comfort for the passengers.

The heat sink has at least one boundary surface facing the room. The boundary surface can have a smooth or a rough surface to influence the absorption and/or reflection behavior thereof. The boundary surface can have a mineral surface, e.g. an internal plaster or a coat of dispersion paint. In other embodiments of the invention, the boundary surface can contain or consist of a metal or an alloy. The capacity of the device according to the invention can be increased due to the comparatively high heat conductivity and/or high heat capacity. A low heat capacity of the heat sink can improve the responsiveness of the device. In some embodiments of the invention, the boundary surface can have an absorbent coating, which shows an absorption of more than 90% or more than 95%, at least in a section of the infrared spectral range. In some embodiments of the invention, it is possible to use a layer that is applied by electroplating and is made of black chromium or black nickel. In other embodiments of the invention, a layer or a layer system consisting of a plurality of individual layers can be applied by a sputtering method, e.g. a titanium oxynitride coating or other ceramic coatings.

When the device is operated, the boundary surface facing the room is brought to a temperature lowered in relation to the heat load. This can be done e.g. by a coolant. The coolant can be cooled e.g. by means of a compression refrigerating machine or a heat pump, as a result of which heat is extracted from the heat sink. In other embodiments of the invention, ground water or surface water can be used to extract heat from the heat sink and to lower the temperature of the boundary surface. In yet another embodiment of the invention, thermoelectric coolers can be used, e.g. Peltier elements.

The heat load can be selected from solar radiation, electric or electronic devices or persons in the room. The infrared heat radiation emitted from the heat load is absorbed by the boundary surface of the heat sink and is removed from the room by the coolant and/or the thermal carrier fluid.

According to the invention, it is now proposed to arrange at least one surface element between the boundary surface and the room, said surface element being at least partially permeable to heat radiation. As a result of the surface element, the ambient air of the room can no longer influence the boundary surface directly. Therefore, the humidity in the room is kept away from the boundary surface, so that it does not condense on the boundary surface. Therefore, the boundary surface can be brought to a temperature below the dew point when the device is operated. As a result, the efficiency of the device is increased and moisture is prevented from precipitating on the boundary surface and contaminating the room, damaging devices or items of furniture, inconveniencing persons, causing structural damage and/or negatively affecting the indoor climate.

However, since the surface element is at least partially permeable to heat radiation, all heat loads in the room, which have a temperature elevated in relation to the boundary surface, can emit infrared heat radiation, which then passes through the surface element and is absorbed in the boundary surface. Heat radiation is electromagnetic radiation of the infrared wavelength range. It spreads in straight fashion and penetrates the surface element. The expression "room temperature radiation" can also be used for the here considered spectral range. Thus, the heat radiation is efficiently absorbed by the heat sink even though the direct influence of the warm room air on the boundary surface is prevented or reduced by the surface element.

In some embodiments of the invention, the surface element can have a transmission of about 50% to about 90% or of about 70% to about 80% at a wavelength between about 3 μm and about 30 μm or between about 6 μm and about 20 μm, at least in a section thereof. In some embodiments of the invention, the surface element can have a transmission of more than about 50% or more than about 70% or more than about 80% at a wavelength between about 6 μm and about 20 μmm, at least in a section thereof. Said wavelength range contains a majority of the energy of the heat radiation of a blackbody radiator at about 300 K. If the cooling device according to the invention is to be used in a warmer climate, this wavelength range can be shifted. Likewise, shorter wavelengths can occur when the room has special heat sources, e.g. electric or electronic devices. A transmission of about 50% to about 90% in at least one section of said wavelength range ensures that a sufficient amount of the heat radiation reaches the boundary surface of the heat sink and can be transported out of the room in this way. At the same time, the transparency and the associated small absorption degree and emission degree of the planar structure ensure that in said wavelength range of the material the planar structure dissipates little heat energy to the heat sink and therefore does not cool down and not drop below the dew point of the room air. At the same time, the planar structure can be designed so as to be at least partially reflecting and/or absorbing in the visible spectral range, such that a visually appealing design is rendered possible. For example, the white ceiling paint that is common in buildings can still be retained.

In some embodiments of the invention, the heat sink can contain a pipe grid and/or a plate heat exchanger and/or a capillary tube mat, through which a coolant can flow. The coolant can be cooled by means of a compression refrigeration machine. In some embodiments of the invention, the coolant can pass through a phase transition. Alternatively, the coolant can be ground water and/or surface water which is conveyed through the pipe grid and/or the plate heat exchanger by means of pumps. Heat can thus be extracted from the heat sink and, as a result, the boundary surface facing the room is cooled to a lower temperature in relation to the room.

In some embodiments of the invention, the surface element can be arranged at a distance from the boundary surface, and therefore an intermediate space is formed between the surface element and the boundary surface, said intermediate space being filled with air or optionally with a protective gas. The protective gas can be selected from argon, nitrogen, synthetic air or dehumidified ambient air. In other embodiments of the invention, the intermediate space between the surface element and the boundary surface can be evacuated. In some embodiments, it is essential for the intermediate space to only have a small water vapor partial pressure so as to avoid the condensation of humidity on the boundary surface. As a result, the boundary surface remains dry and the efficiency of the device does not deteriorate. Furthermore, the surface element facing the room is warmer than the boundary surface when the device is operated since the intermediate space can serve as insulation and, as a result, the side of the surface element that faces the room does not cool below the dew point of the room air. The occurrence of structural damage, such as mold, can thus be avoided.

In some embodiments of the invention, the device can also have a dehumidifying apparatus, by means of which water can be removed from the intermediate space between the surface element and the boundary surface. As a result, water which penetrates the at least one surface element or the edge compound when the device is operated, can be removed from the intermediate space. It is thus possible to keep the intermediate space reliably free from water, such that the boundary surface is free from condensate or the condensate accumulation is at least reduced and can be transported off the boundary surface. A disturbance-free operation can thus be obtained over a prolonged period of time.

In some embodiments of the invention, the dehumidifying apparatus can contain or consist of at least one sorbent and/or at least one micro-pump and/or at least one heating apparatus and/or at least one valve and/or at least one ventilator and/or one fleece. Thus, moisture occurring in the intermediate space can either be sorbed chemically, e.g. by silica gel, zeolites or similar drying agents. In other embodiments of the invention, a micro-pump can be available cumulatively or alternatively, said micro-pump pumping humidity and condensate that accumulate out of the intermediate space. In yet another embodiment, the moisture can be expelled from a sorbent by means of at least one heating apparatus and/or the intermediate space can be heated until dry. Finally, some embodiments of the invention can have valves which operate either as spring-loaded check valves and/or can be controlled by means of mechanical drive means, e.g. by electromagnetic coils or piezo actuators. In cooperation with at least one ventilator, the intermediate space can be rinsed by dry protective gas which is supplied to the intermediate space by the ventilator and/or another conveyor apparatus and leaves the intermediate space through at least one valve.

In some embodiments of the invention, the at least one surface element can contain a polymer. In some embodiments of the invention, the polymer can be selected from polyethylene and/or polymethyl methacrylate and/or polyvinyl chloride and/or polypropylene and/or polyethylene terephthalate and/or polyester and/or biaxially oriented polyester film and/or cellulose acetate butyrate and/or cellulose acetate polymer. These materials have a high diffusion resistance for water vapor, such that only a small amount of moisture can penetrate the intermediate space. In addition, these surface elements can also be used safely as overhead glazing because of their resistance to breakage when the heat sink with the boundary surface is arranged in the ceiling region.

In some embodiments of the invention, the device can contain one, two or three surface elements which are each arranged at a distance from one another and from the boundary surface. As a result, a plurality of intermediate spaces is formed and the humidity is kept away from the boundary surface with a higher reliability and/or, on account of the improved heat insulation, a greater temperature difference can exist between heat load and boundary surface.

In some embodiments of the invention, the at least one surface element and the heat sink can be enclosed by an edge compound which contains at least one sealing element. In some embodiments of the invention, the sealing element can contain or consists of polyisobutylene and/or silicone and/or butyl rubber. Such an edge compound can be made in a way similar to insulation glass pane edge joints known per se. Therefore, the penetration of moisture into the intermediate space is prevented by the sealing elements of the edge compound in a reliable and permanent fashion and leads to a long service life of the device, even in the case of daily use.

In some embodiments of the invention, the at least one surface element and the heat sink can be surrounded by an edge compound which is carried out by thermal joining. This allows a rapid and cost-effective manufacture and/or the edge compound can be made particularly tight.

In some embodiments of the invention, the at least one surface element can be connected to a frame which is attached by mechanical or magnetic closure mechanisms on the heat sink and the further components of the device. This allows for a simple replacement of the surface element in the case of damage or for inspection.

In some embodiments of the invention, at least one sound absorber can be integrated into the device according to the invention, such that the device can effect both thermal and acoustic optimization of a room.

In some embodiments of the invention, the device can have a cooling capacity of more than about 70 $W \cdot m^{-2}$ or more than about 90 $W \cdot m^{-2}$ or more than about 100 $W \cdot m^{-2}$.

In some embodiments of the invention, it relates to a method for heating a room, comprising at least one heat sink having at least one boundary surface which faces the room and is brought to a temperature raised with respect to a heat sink in the room, wherein at least one surface element is arranged between the boundary surface and the room, said surface element being at least partially permeable to heat radiation.

In this embodiment of the invention, the heat sink can be operated in cool weather also with a heat carrier fluid that is warmer in relation to the room temperature so as to provide in this way a heating device. As a result, e.g. persons in the room can have a comfortable indoor climate. On account of the planar structure between the then heated boundary surface and the room, the convection is reduced so that a radiation heating is predominantly present. This can be perceived by some persons as more pleasant than the heating with conventional planar heaters or radiators, which cause a higher convection of the air in the room.

The invention shall be explained in more detail below by means of drawings without limitation of the general inventive concept.

FIG. 1 shows a first embodiment of the device 1 for air-conditioning a room 2. A cross-section through a device according to the invention is shown.

The device 1 contains a heat sink 10 having at least one boundary surface 100. The heat sink 10 can contain a material having a high heat conductivity, e.g. a metal or an alloy, in particular an aluminum or copper alloy. The boundary surface 100 can be provided with an infrared absorbing coating, e.g. a coat of paint, a sputter layer or an electroplating layer. In particular, the absorption of the room temperature radiation can thus be increased.

The surface of the heat sink 10, which is opposed to the boundary surface 100, is provided with heat insulation 120. The heat insulation 120 can contain or consist of rigid foam, a vacuum insulation, or a mineral wool. The heat insulation 120 can have a multi-layered structure. The side of the heat insulation 120 that faces away from the heat sink 10 is lined with a stiffening element 12, which, on the one hand, can effect a mechanical stabilization of the device and, when it stands alone in the room, can also have a decorative appearance. The stiffening element 12 can be e.g. a plastics plate, a metal sheet, a hardboard, a medium density fiberboard or any other wood material.

For the integration into a building or a vehicle or aircraft, the device can be attached to a ceiling via the rear side of the stiffening element 12, e.g. by adhesion or screws, as explained below by means of FIG. 18.

In order to extract heat from the heat sink 10, the illustrated embodiment has a pipe grid 11, through which e.g. water or another coolant known per se can flow. The pipe grid extracts heat from the heat sink during operation, as explained in more detail below by means of FIG. 8. The coolant is supplied to the pipe grid 11 via a line 110.

The boundary surface 100 faces the room 2 and, as a result, heat radiation from the room 2 can reach the boundary surface 100 where it is absorbed. In order to avoid a direct influence of the room air on the boundary surface 100 and a subsequent precipitation of moisture, the illustrated embodiment has two surface elements 31 and 32. These elements enclose one intermediate space 310 and 320 each, which is either evacuated or contains a protective gas atmosphere.

The protective gas atmosphere is distinguished by a small amount of gaseous water and/or moisture, and therefore the humidity does not precipitate on the boundary surface 100.

Nevertheless, the surface elements 31 and 32 are at least partially transparent or translucent in the infrared spectral range of the room temperature radiation, and therefore the heat radiation from room 2 penetrates the surface elements 31 and 32 and can be absorbed by the boundary surface 100. This allows the operation of the device, which can be designed e.g. as a cooling ceiling or wall element, even at high humidity and large temperature spread without moisture precipitating, thus leading to structural damage.

The surface elements 31 and 32 can consist of glass or sintered, IR-transparent materials or plastics. In particular in the case of an overhead use on ceiling elements, a plastics element can advantageously be used on account of its low weight and breaking strength. Such a plastics element can consist of or contain a film web.

FIG. 1 also shows an edge compound 13, which receives the ends of the surface elements 31 and 32 and seals them in an approximately gas-tight fashion. As a result, no moisture from the environment can penetrate the first intermediate space 310 and the second intermediate space 320 via the edge.

FIG. 1 also shows an optional dehumidifying apparatus 4, which is integrated into the edge compound 13 and by means of which penetrating water can be removed from the intermediate space 310 and 320. In the illustrated embodiment, a first valve 41 is assigned to the first intermediate space 310. A second valve 42 is associated with the second intermediate space 320. The valves can be designed as check valves which release an air flow 39 to the outside when a dry gas flow is supplied to the intermediate spaces 310 and 320 by means of a ventilator or another conveying apparatus and removes the moisture out of the intermediate spaces. In addition, the valves 41 and 42 can be used for pressure compensation when the pressure of the gas atmosphere drops in the first intermediate space 310 and in the second intermediate space 320 due to the cooling. As a result, the surface elements 31 and 33 always remain even during operation. In some embodiments of the invention, the surface elements 31 and 32 can be stabilized during the operation of the device by an excess pressure in the intermediate spaces 310 and 320.

Figure 2:
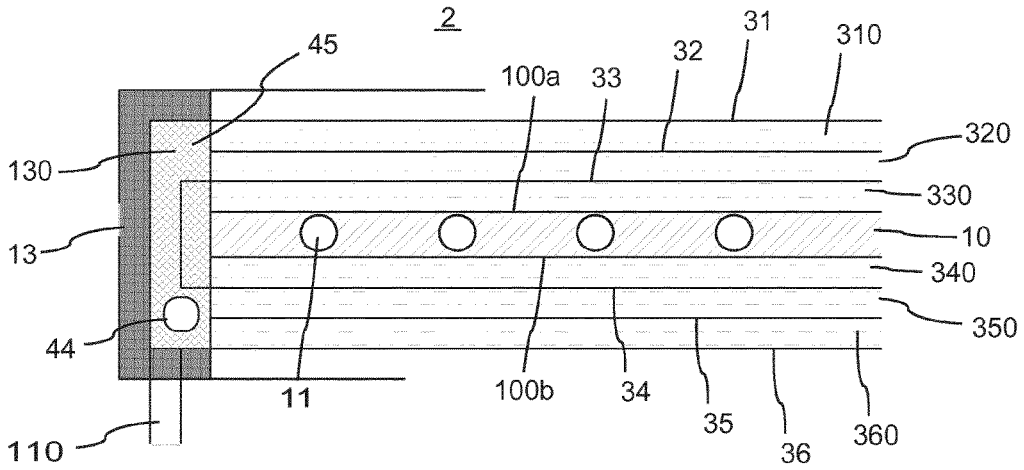
FIG. 2 shows a cross-section through a second embodiment of the device according to the invention for air-conditioning.

FIG. 2 illustrates a second embodiment of the invention. The same references signs designate the same elements of the invention, and therefore the below description is limited to the essential differences. FIG. 2 also shows a heat sink 10, which can consist e.g. of a capillary tube mat made of a metal or an alloy. In this case, too, the heat sink 10 is provided with a pipe grid 11, through which a heat carrier can flow to dissipate heat from the heat sink 10.

The heat sink 10 has two boundary surfaces 100*a* and 100*b*, which are arranged on opposite surfaces of the heat sink 10. As a result, the surface area available for cooling can be doubled to increase the output of the device.

In each case, three surface elements 31, 32 and 33 or 34, 35 and 36 are arranged on each side of the heat sink 10. A first intermediate space 310 is arranged between the surface elements 31 and 32. A second intermediate space 320 is arranged between the second surface element and the third surface element 33. Finally, a third intermediate space 330 is formed between the third surface element 33 and the first boundary surface 100*a*. A fourth surface element 34 is disposed on the opposite side of the heat sink 10 so as to form a fourth intermediate space 340 between the second boundary surface 100*b* and the fourth surface element 34. A fifth surface element 35 borders on the fourth surface element 34, and these two elements enclose a fifth intermediate space 350. Finally, a sixth surface element 36 is provided for the purpose of completion. This element encloses a sixth intermediate space 360 together with the fifth surface element 35. The insulation can be further improved by three surface elements and three intermediate spaces and serves, on the one hand, to avoid an undesired cooling of the outermost surface element facing the room and, on the other hand, to further reduce the penetration of moisture since each intermediate space has only a small moisture gradient in relation to its adjacent intermediate space.

For the purpose of integration in a building or a vehicle or aircraft, the second embodiment can be attached in such a way that it is suspended from the ceiling. As a result, heat radiation impinges on the heat sink 10 on both sides.

In this case, too, the device 1 is provided with an edge compound 13, which encloses the heat sink 10 and the six surface elements. In the illustrated embodiment, the edge compound 13 has a cavity 130, which can be provided with an optional sorbent 45 or a seal. The sorbent 45 removes penetrated moisture from the intermediate spaces 310, 320, 330, 340, 350 and 360.

In order to regenerate the sorbent 45 when it is loaded with moisture, at least one optional heating element 44 can be provided. The heating element 44 can either be designed as a pipe grid, through which a heat carrier can flow. For example, an oil or a heating water can be used for this purpose. Alternatively or additionally, the heating device 44 can contain or consist of an electric heating element in order to be able to regenerate the sorbent 45 also independently of a central heating system.

Figure 3:
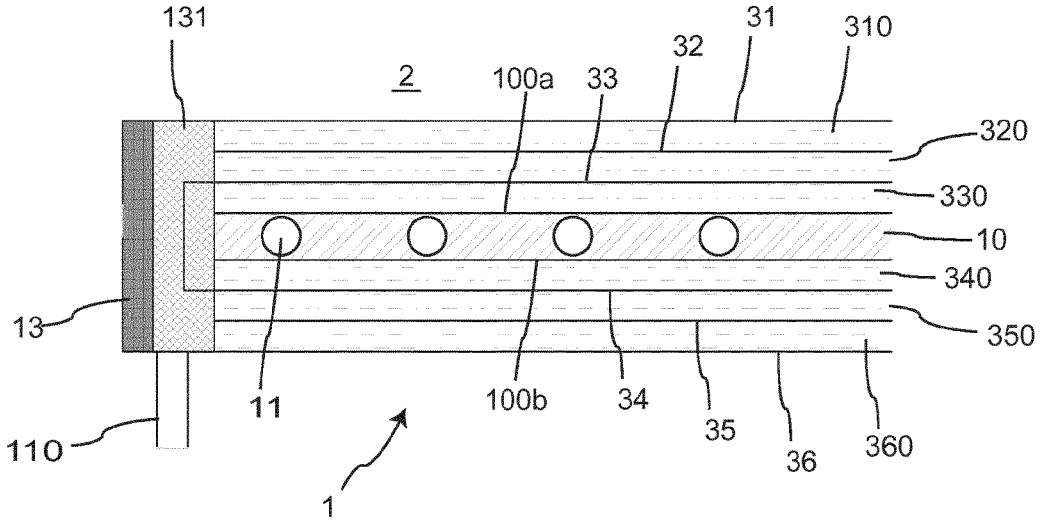
FIG. 3 shows a cross-section through a third embodiment of the device according of the invention for air-conditioning.

FIG. 3 shows a third embodiment of the present invention. Since this third embodiment is similar to the above described second embodiment, the following description is limited to the essential differences. In this case, too, the same reference signs designate the same components.

The essential difference of the third embodiment relates to the edge compound 13. The latter contains a sealing element 131, which contains or consists of e.g. polyisobutylene and/or silicone and/or butyl rubber. The edge compound thus has a similar structure as an insulation glass pane edge joint known per se. Therefore, the edge compound can be produced by methods known per se from the insulated glass window production. This leads to a reliable closure of the surface elements and the heat sink 10 with little effort.

Figure 4:
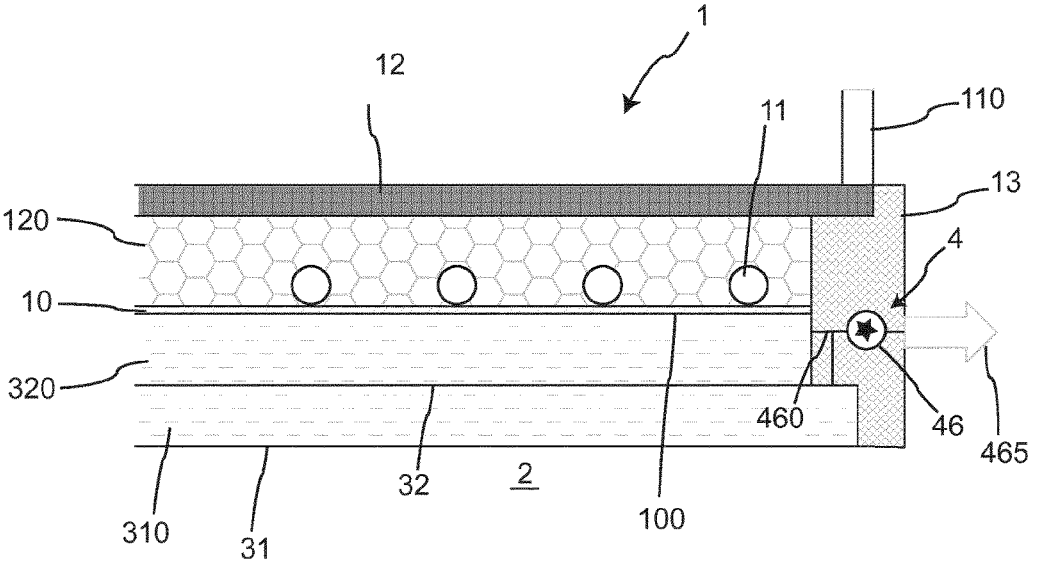
FIG. 4 shows a cross-section through a fourth embodiment of the device according to the invention for air-conditioning.

FIG. 4 describes a fourth embodiment of the invention. The fourth embodiment is similar to the above described first embodiment. Therefore, the same reference sings designate the same components of the invention and the below description only discusses the essential differences.

In the fourth embodiment, a micro-pump 46 is disposed in the edge compound 13. This micro-pump is provided with connection lines 460, all of which open into the intermediate spaces 310 and 320. In this way, the micro-pump 46 can remove moisture from the intermediate spaces 310 and 320 and discharge this moisture as a moisture flow 465. This allows for continuous draining of the first intermediate space 310 and the second intermediate space 320 and, as a result, the device can also be operated reliably over a prolonged operating period.

Figure 5:
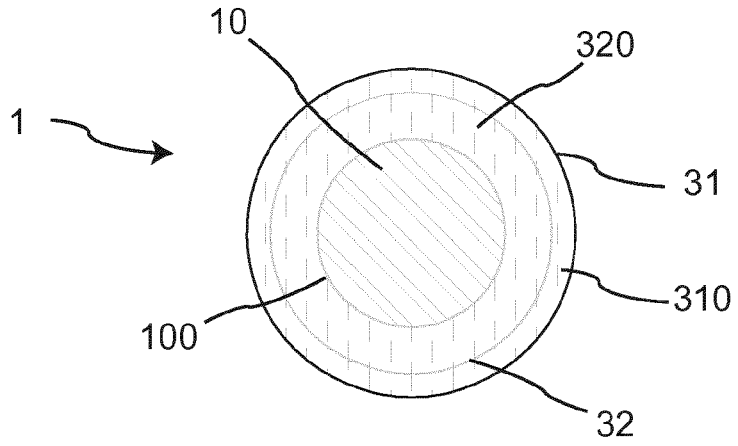
FIG. 5 shows a cross-section through a fifth embodiment of the device according to the invention.
Figure 6:
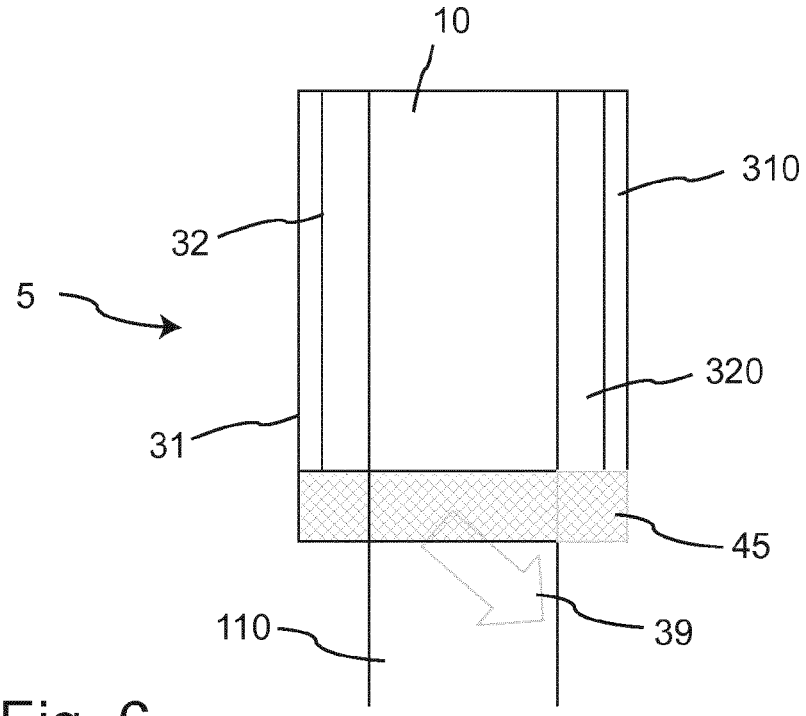
FIG. 6 shows a longitudinal section through the fifth embodiment.
Figure 7:
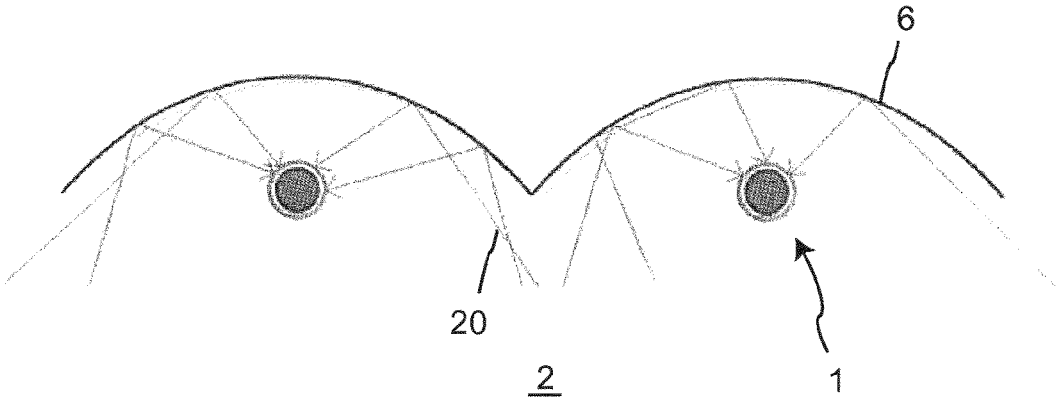
FIG. 7 shows the mode of operation of the fifth embodiment of the invention.

FIGS. 5, 6 and 7 describe below a fifth embodiment of the invention. The fifth embodiment, which is shown as a section in FIG. 7, has a plurality of cylindrical heat sinks, which have an approximately tubular appearance. They are arranged in the focus of a reflector 6. In the illustrated embodiment, the reflector 6 has a circular arc-like cross-section. Of course, it is also possible to use other forms for the reflector 6, e.g. hyperbolic or parabolic cross-sections.

The heat sinks are preferably, but not necessarily, arranged in the focus or the focal area of the reflectors 6. In this way, heat radiation 20, which impinges from the room on the reflectors 6, is focused on the heat sink. The reflectors 6 can be made e.g. of a metal or an alloy. The reflectors 6 can also have an infrared reflecting coating in order to increase the efficiency of the device. The coating can be applied by electroplating and/or from the gas phase, e.g. by means of CVD or PVD or sputtering methods, all known per se.

The heat sinks arranged in the focus are shown in FIG. 5 in cross-section and in FIG. 6 in longitudinal section. As is clear from the drawings, the heat sink 10 has approximately the shape of a circular cylinder and forms the core of a concentric arrangement consisting of a plurality of surface elements 31 and 32. In this case, too, the heat sink 10 can be actively cooled, e.g. by a shell and tube heat exchanger, a pipe grid or other measures known per se. The cylinder lateral surface of the tubular heat sink 10 serves as a boundary surface 100.

In order to avoid condensation of the humidity in the room on the boundary surface 100, it is concentrically surrounded by a first surface element 31 and a second surface element 32.

The surface elements therefore have the form of a pipe or a hollow cylinder. Intermediate spaces 310 and/or 320 are designed between the surface elements and the boundary surface 10 and, on the one hand, insulate the boundary surface 100 against the room and, on the other hand, prevent the direct air access. For this purpose, the intermediate spaces 310 and 320 can either be evacuated or be provided with a protective gas atmosphere, as described above.

As is clear from FIG. 6, the ends of the tubular elements can again be provided with an edge compound and/or a sorbent 45 so as to remove moisture 39 from the intermediate spaces 310 and 320.

Figure 8:
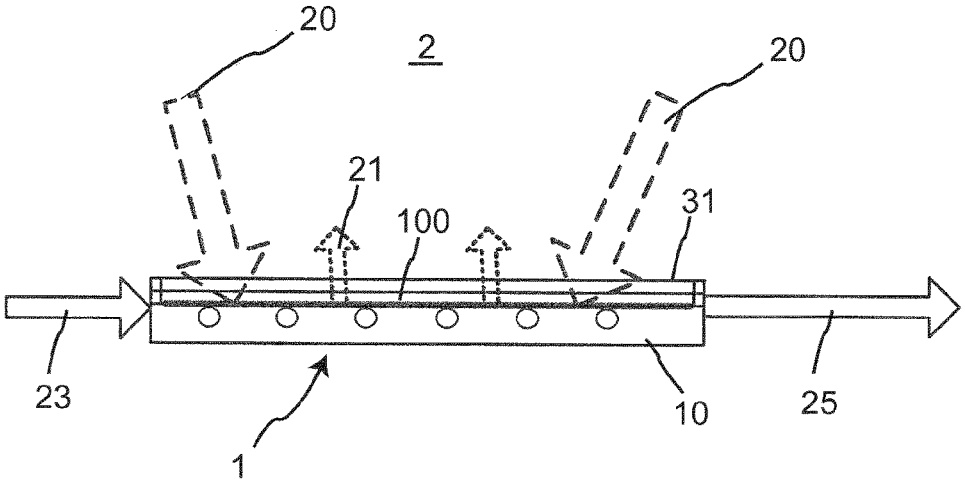
FIG. 8 shows the fundamental mode of operation of the device according to the invention.

The mode of operation of the invention is explained once again below by means of FIG. 8. FIG. 8 shows a device 1 for air-conditioning a room. This device contains a boundary surface 100 and at least one surface element 31, as described above. Heat radiation 20 from the room 2 is radiated isotropically and thus also reaches the boundary surface 100 to some extent.

The boundary surface 100 also emits a heat radiation 21, which is radiated into the room 2. Since the temperature of the boundary surface 100 is lower than the temperature of the heat loads in the room, the heat flow 21 is, however, lower than the heat flow 20. As a result, a net heat flow is removed from the room 2 and placed in the heat sink 10 of the device 1.

Furthermore, a coolant, e.g. ground water, is supplied to the heat sink 10. The coolant has a finite temperature and thus introduces a heat flow 23 into the heat sink 10. However, since the temperature of coolant is increased by the net heat flow coming from the room, the coolant discharges a heat flow 25 from the heat sink 10, which is greater than the supplied heat 23. It is thus possible to reliably dissipate the heat from the heat sink 10 and the net heat flow can be permanently removed from the room 2.

Since the at least one surface element 31 prevents the direct air access from the room 2 to the boundary surface 100, a condensation of moisture on the boundary surface 100 is reliably avoided even if the temperature is cooled below the dew point. Therefore, the cooling capacity can be greater than about 70 $W \cdot m^{-2}$ or greater than about 90 $W \cdot m^{-2}$ or greater than about 100 $W \cdot m^{-2}$.

Figure 9:
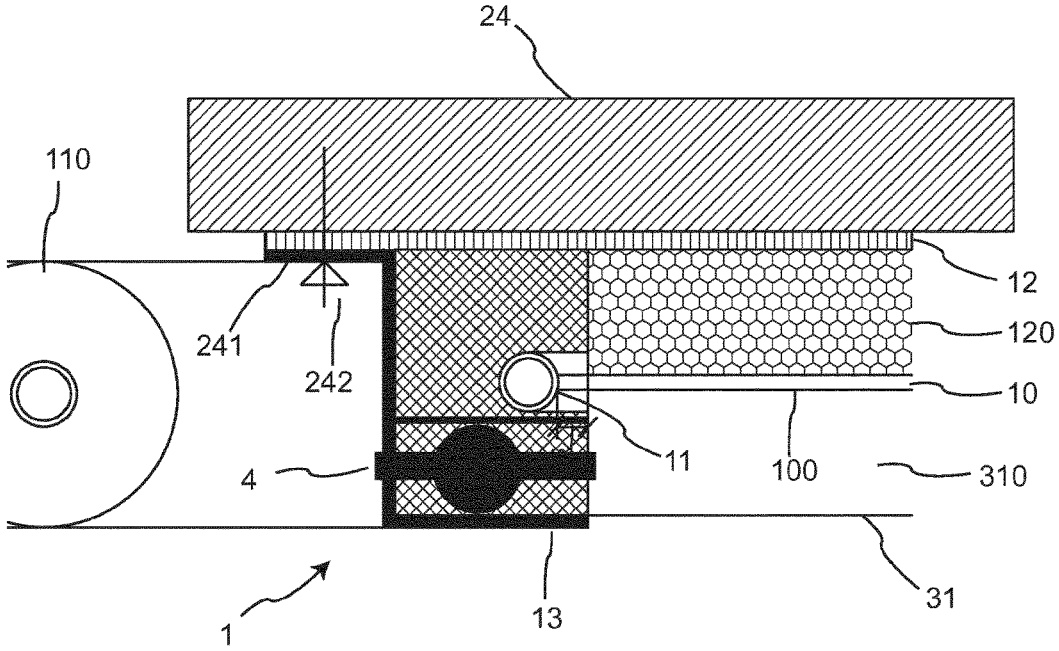
FIG. 9 shows a sixth embodiment of the device according to the invention for air-conditioning.

A sixth embodiment of the device according to the invention for air-conditioning is explained in more detail by means of FIG. 9. In this case, too, the same components of the invention are provided with the same reference signs, and therefore the below description is limited to the essential differences. The device 1 for air-conditioning has a similar structure as already described above by means of FIGS. 1 and 4. This embodiment of the invention also contains heat insulation 120, on which the heat sink 10 is mounted. The surface element 31, which is arranged at a distance 310 from the boundary surface 100 of the heat sink 10, prevents the room air with the included humidity from directly accessing the heat sink 10.

Unlike the above-described embodiments, the device 1 according to the sixth embodiment has no capillary tube mat as the heat sink 10. On the contrary, the heat sink 10 consists substantially of a flat material layer made from a metal or an alloy, e.g. aluminum or copper. This layer is connected via at least one edge to a pipe 11, through which a coolant can flow. The coolant can be liquid or gaseous, as already described above, or undergo a phase transition in the pipe 11, e.g. from gaseous to liquid, such that, in this process, the condensation heat is supplied by the heat sink 10 and the boundary surface 100 cools down appropriately. The pipe 11 for the coolant can run in the edge compound 13.

The stiffening element 12 on the rear side of the heat insulation 120 has a protrusion 241. This protrusion 241 protrudes from the edge compound 13 and forms a mounting flange for the device 1. As is also shown in FIG. 9, the device 1 can be attached to a component 24 of a building, e.g. a ceiling, by means of the protrusion 241 and a screw connection 442.

A supply line 110 for the coolant can run next to the device 1. The line 110 can optionally be provided with an insulation to prevent heat losses and/or an undesired heat input outside the device 1.

Figure 10:
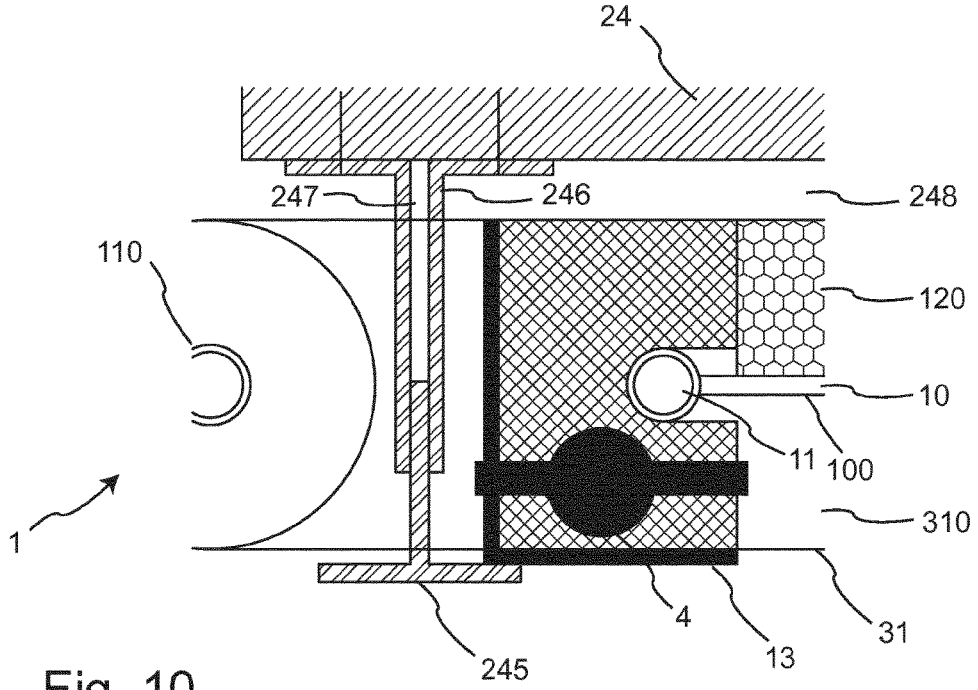
FIG. 10 shows a seventh embodiment of the device according to the invention for air-conditioning.

FIG. 10 shows a seventh embodiment of the device according to the invention for air-conditioning. Since the seventh embodiment is similar to the sixth embodiment, the below description is limited to the essential differences. As is clear from FIG. 10, the structure of the device 1 is similar to that already described above by means of FIG. 9. However, the seventh embodiment does not have the stiffening element on the side of the heat insulation 120 that faces away from the heat sink 10. This embodiment has a lower weight and lower manufacturing cost.

In order to mount the device 1 on a ceiling 24, a holding device 245 is used, which has an approximately T-shaped cross-section. In this case, the edge compound 13 rests on the inner side of the T-shaped cross-section. In order to be able to adjust the ceiling distance, a holding element 246 is mounted on the ceiling 24. This holding element has a groove 247 in which the holding device 245 is guided. The holding device 245 is slidably mounted on the holding element 246 and can be fixed in predeterminable positions. Due to this, a gap 238 is obtained between the rear side of the heat insulation 120 of the device 1 and the underside of the ceiling 24. This gap 248 serves for the rear ventilation of the device 1. Furthermore, a structural tolerance can be compensated by the variable ceiling distance, and therefore the surface element 31, which defines the optical overall impression of the device 1 and of the room equipped therewith, is adjusted in such a way that it runs horizontally.

Figure 11:
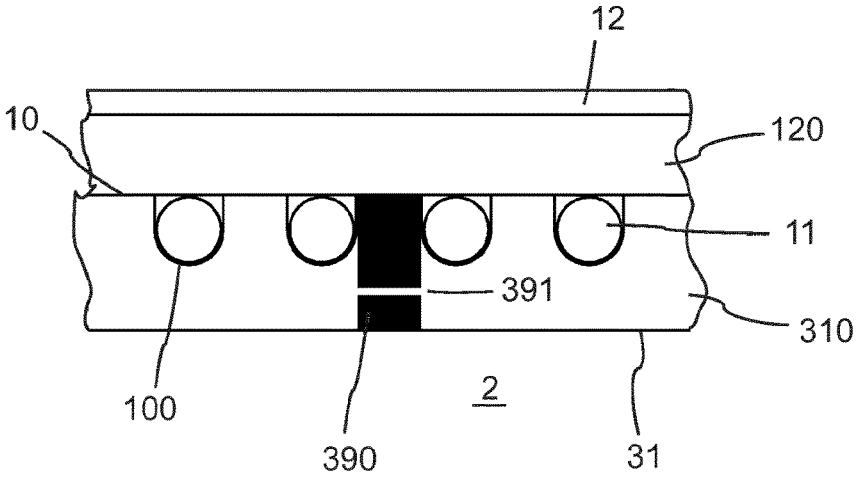
FIG. 11 shows an eighth embodiment of the device according to the invention for air-conditioning.

FIG. 11 shows an eighth embodiment of the device according to the invention in cross-section. The eighth embodiment is also similar to the first embodiment explained by means of FIG. 1, and therefore the description is limited to the essential differences. The eighth embodiment has a plate-like or cuboid-like heat insulation 120.

Unlike the first embodiment where the capillary tubes 11 of the heat sink 10 are embedded in the heat insulation 120, the capillary tubes 11 of the heat sink 10 of the eighth embodiment protrude into the intermediate space 310 between the boundary surface 100 and the surface element 31.

Furthermore, the eighth embodiment illustrates the use of spacers 390, which are arranged in the intermediate space 310 and which keep the distance of the surface element 31 and/or the width of the intermediate space 310 constant or approximately constant. It is thus possible to prevent the surface element 31 from being curved inwardly or outwardly when the pressure in the intermediate space 310 changes due to a temperature change.

The spacers 390 can be made of a plastic material, a rigid foam, or another material having a high heat resistance, such that no heat bridges are formed at the surface element 31.

At least some of the spacers 390 can have optional overflow channels 391, which render possible a gas exchange on both sides of the spacer 390 in the intermediate space 310. As a result, a gas flow draining the intermediate space 310 can also be guided through the spacer 390 or a gas can be supplied or discharged for pressure compensation in the intermediate space 310.

Figure 12:
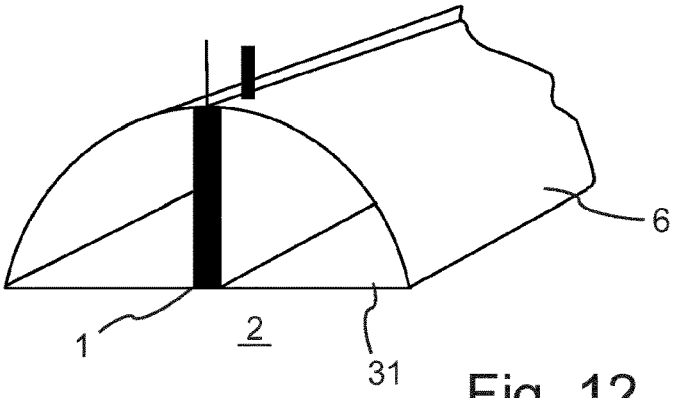
FIG. 12 shows a ninth embodiment of the device according to the invention for air-conditioning in an axonometric presentation.
Figure 13:
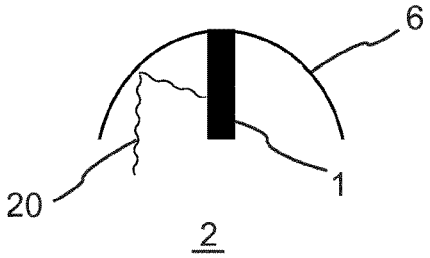
FIG. 13 shows the ninth embodiment of the device according to the invention for air-conditioning in cross-section.

FIGS. 12 and 13 illustrate a ninth embodiment of the invention. FIG. 12 shows an axonometric representation and FIG. 13 shows a cross-section.

The ninth embodiment uses a reflector as already explained above by means of the fifth embodiment. The reflector of the ninth embodiment can be e.g. semi-circular or parabolic. The inner side of the reflector 6 can be provided with an infrared reflecting coating. This avoids the absorption of heat radiation and the heating of the reflector 6. As a result, the efficiency of the device according to the invention can be improved.

The opening of the reflector 6 that faces the room can either be open or be closed by a surface element 31, as already explained in more detail above by means of FIGS. 1 to 11.

A device 1, which contains a heat sink having a boundary surface, is disposed approximately in the focal area of the reflector 6. If the surface element 31 is not attached to the reflector 6, the device 1 has at least one surface element 31, which prevents the access of humid room air to the boundary surface 100, as illustrated above by means of FIGS. 5 and 6. The essential difference between the device 1 according to FIG. 12 and the device 1 according to FIGS. 5 and 6 is that the device 1 of the ninth embodiment of the invention has no circular, but a polygonal, preferably rectangular, cross-section. The larger axis of the rectangular cross-section here corresponds approximately to the height of the profile of the reflector 6. This feature has the effect that the heat radiation impinges on the heat sink irrespective of the entrance angle. Since most of the heat loads emit heat radiation in diffuse fashion, the cooling capacity of the ninth embodiment of the device can be larger than the cooling capacity of the fifth embodiment of the invention.

Figure 14:
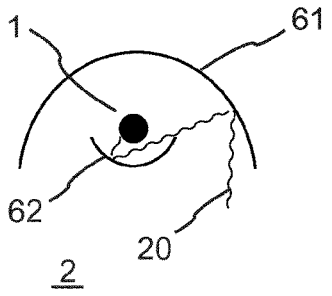
FIG. 14 shows a tenth embodiment of the device according to the invention for air-conditioning in cross-section.

FIG. 14 shows a tenth embodiment of the invention. This embodiment is also similar to the fifth embodiment. The tenth embodiment also has a cylindrical heat sink 1, which is arranged in the focus of a first reflector 61. The heat radiation 20 that does not impinge in vertical fashion on the first reflector 61 is not focused in the focal point and, therefore, does not reach the heat sink in the device 1.

However, according to the tenth embodiment of the invention, this heat radiation impinges on a second reflector 62, which is arranged below the first reflector 61 and has a smaller radius. The radiation is therefore reflected on the second reflector 62 and thus reaches the boundary surface of the heat sink inside the device 1. In this way, the output of the fifth embodiment can be increased and/or the effect can be improved.

Figure 15:
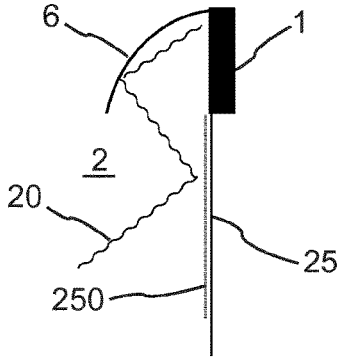
FIG. 15 shows an eleventh embodiment of the device according to the invention for air-conditioning in cross-section.

FIG. 15 shows an eleventh embodiment of the device according to the invention in cross-section. The eleventh embodiment has a device 1 with a heat sink and a boundary surface facing the room, as described above. The boundary surface and the heat sink are integrated in a wall 25, which can be designed e.g. as a drywall or as a solid construction.

A reflector 6 is disposed adjacent to the upper edge of the device 1 and has approximately the shape of a quadrant or the shape of a parabola half. This means that the vertex of the reflector 6 coincides approximately with the upper edge of the device 1. Heat radiation 20, which impinges from the room on the inner side of the reflector 6, is reflected to the boundary surface of the heat sink of the device 1 where it is absorbed. As a result, a good heat dissipation of the heat loads can be achieved in the room 2 even if the active boundary surface is small.

The wall 25 can optionally be provided with an infrared reflecting coating 250. As a result, heat radiation 20, which is initially radiated from the room onto the wall 25, can be reflected onto the inner side of the reflector 6 to be thus removed from the room 2. The infrared reflecting coating 250 can be applied e.g. as a wall paint to the wall 25 and adds to the acceptance range of the optical picture formed of the device 1 and the reflector 6.

Figure 16:
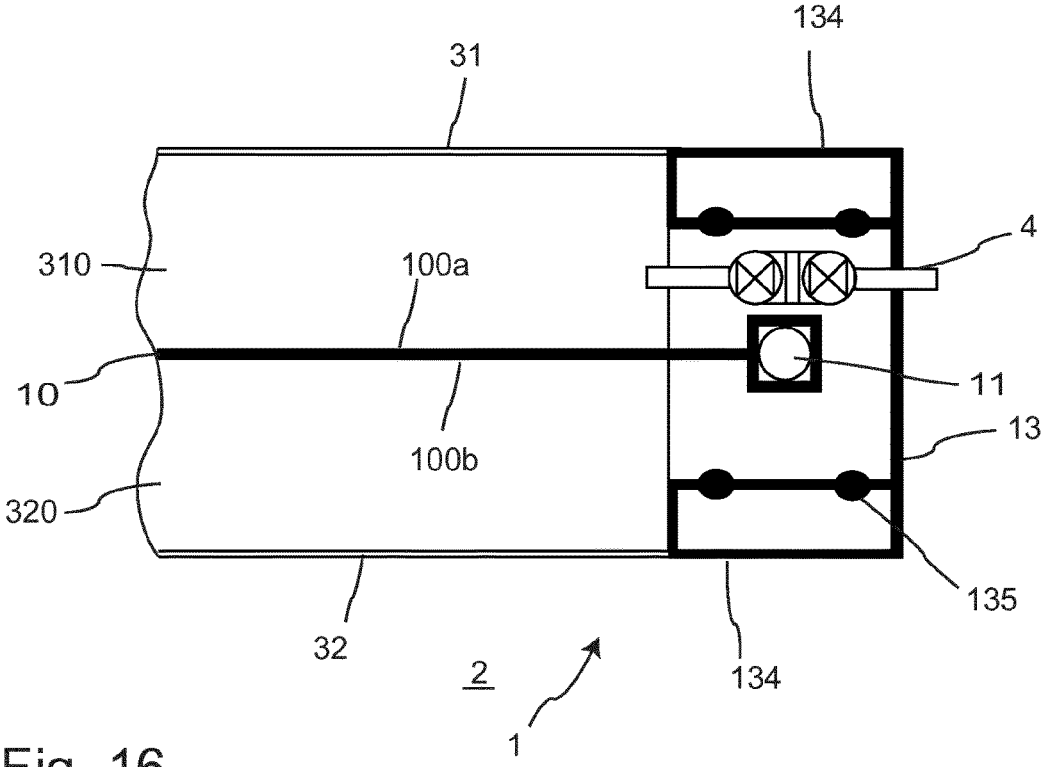
FIG. 16 shows a twelfth embodiment of the device according to the invention for air-conditioning in cross-section.

FIG. 16 illustrates a twelfth embodiment of the device 1 according to the invention. The twelfth embodiment has a heat sink 10, which has two boundary surfaces 100*a* and 100*b* opposite to each other, as already described by means of FIGS. 2 and 3. Each boundary surface 100*a* and 100*b* is protected by a surface element 31 and 32 against the access of humid room air, wherein each surface element is spaced apart by an intermediate space 310 and 320 from the boundary surface 100*a* and 100*b*.

The edge portion of the heat sink 10 is connected to a coolant line 11 in thermally conductive fashion, as already explained by means of the sixth embodiment shown in FIG. 9.

Furthermore, FIG. 16 shows the attachment of the surface element 31, which can consist of e.g. a film web, to a frame 134. The frame 134 can also contain or consist of a polymer material. In this case, the surface element 31 can be attached to the frame 134 in a simple way by thermal joining. In some embodiments of the invention, a laser welding method or a contact welding method can be used to heat the material of the frame 134 and of the surface element 31 in predeterminable areas of the room above the glass transition temperature, thus sealing it.

The frame 134 is attached to the edge compound 13 is attached by a mechanical fixing device 135. The fixing device 135 can comprise e.g. a magnetic attachment or a snap lock. In some embodiments of the invention, sealing elements can optionally be present to prevent ambient air from entering the intermediate space 310 and/or 320.

Figure 17:
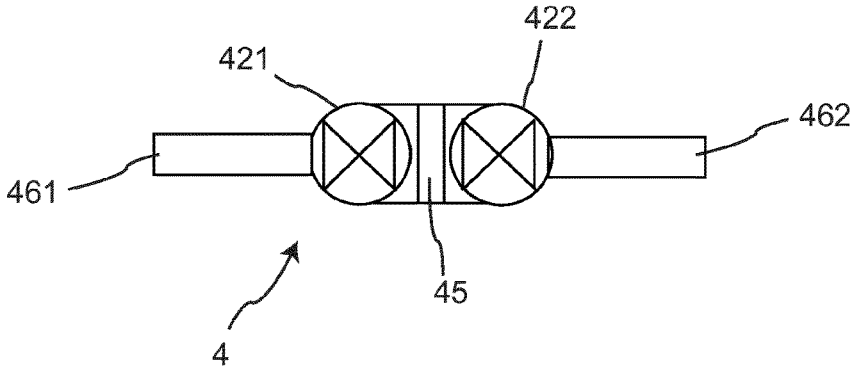
FIG. 17 shows an embodiment of a dehumidifying apparatus in detail.

Furthermore, FIG. 16 shows a dehumidifying apparatus 4, the functioning of which is explained by means of FIG. 17.

FIG. 17 shows that the dehumidifying apparatus 4 has a first valve 421 and a second valve 422. The first valve 421 opens into a supply line 461, which opens into the intermediate space 310.

The second valve 422 is connected to a discharge line 462, which opens into the outer region and/or the vicinity of the device 1.

A sorbent 45, e.g. a zeolite or silica gel, is arranged between the two valves and can bind humidity from the ambient air.

After opening the first valve 421, moisture can flow from the intermediate space 310 through the supply line 461 into the sorbent 45 where it is bound.

When the sorbent 45 is saturated, the valve 421 can be closed and the valve 422 can be opened. By baking out the sorbent 45, e.g. by an electrical heating apparatus (not shown), the moisture can be removed from the sorbent 45 and leave the device through the discharge line 462.

After the sorbent 45 has dried and is thus reactivated, the valve 422 is closed and the valve 421 is opened. This process can be continued in cycles, such that the intermediate space 310 is continually dried.

Figure 18:
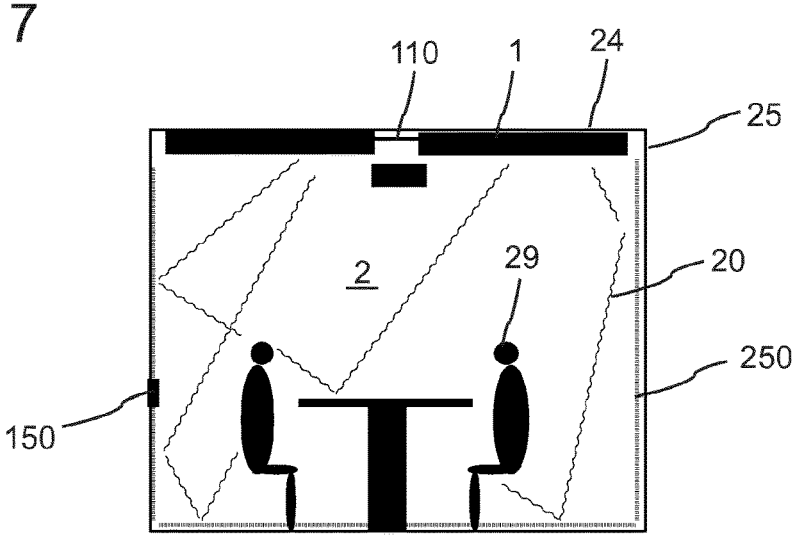
FIG. 18 shows the use of the first embodiment of the invention.

FIG. 18 shows the use of the first embodiment of the invention. It shows a room 2 with at least one wall 25 and one ceiling 24. A device 1 is attached to the ceiling 24 and has a boundary surface 100 facing the room 2.

Furthermore, the ceiling 24 can be provided with additional installations, e.g. lighting equipment or acoustic panels.

FIG. 18 shows, by way of example, two persons as the heat load 29. They give off heat radiation 20, which is substantially undirected. Therefore, a certain amount of the heat radiation 20 can directly reach the boundary surface of the device 1 where it is absorbed and can be removed from the room 2 by the coolant circulating in the line 110. Another part of the heat radiation 20 can be reflected on surfaces of the room, e.g. of a tabletop, and in this way reach the boundary surface of the device 1. Finally, FIG. 18 shows the optional use of an infrared reflecting coating 250 on the walls 25, such that radiation 20 reflected by the heat loads 29 can be reflected on floor and/or wall surfaces and in this way reaches the boundary surface of the heat sink of the device 1.

An optional control device 150 can be available in room 2 and prevents an excessive cooling of the heat loads 29.

Figure 19:
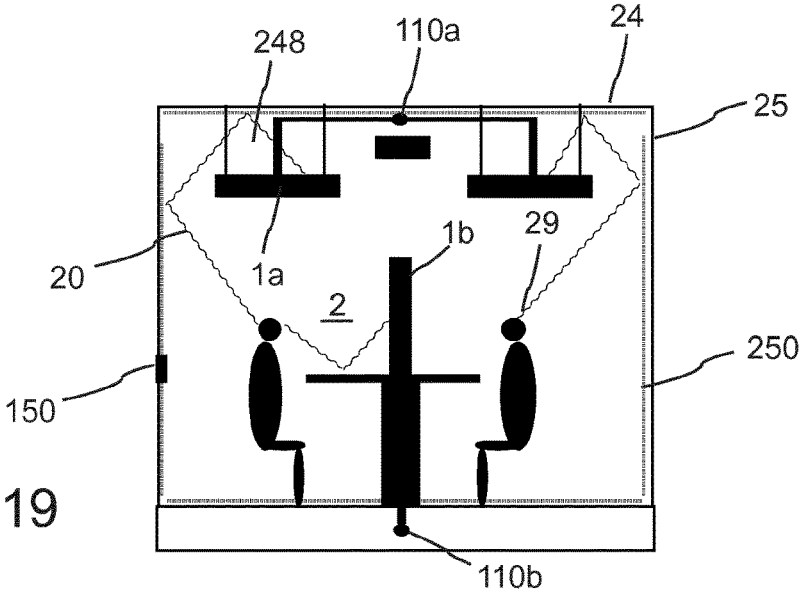
FIG. 19 shows the use of the second embodiment of the invention.

FIG. 19 shows the use of the second embodiment of the invention. The same reference signs designate the same components of the invention.

The second embodiment of the invention has two opposite boundary surfaces 100*a* and 100*b*, as explained e.g. by means of FIG. 2. Therefore, the device 1 is attached at a distance from the ceiling 24 so as to form a gap 248 between the ceiling 24 and the overhead boundary surface.

Heat radiation 20, which is radiated from the heat loads 29, can thus either reach the lower boundary surface or, due to reflection on the walls 25 and the ceiling 24, the upper boundary surface. As a result, the output of the device 1 can be increased when heat is dissipated from the heat load 29.

In addition to the ceiling-mounted device 1*a*, FIG. 19 shows a device 1*b*, which is used as a room divider and also has two boundary surfaces that face the right-hand side and left-hand side of the room. Therefore, heat radiation from a heat load 29 can also be absorbed on the boundary surfaces of the second device 1*b*. Coolant can in this case be supplied via a coolant line 110*b* running in a cavity bottom.

Figure 20:
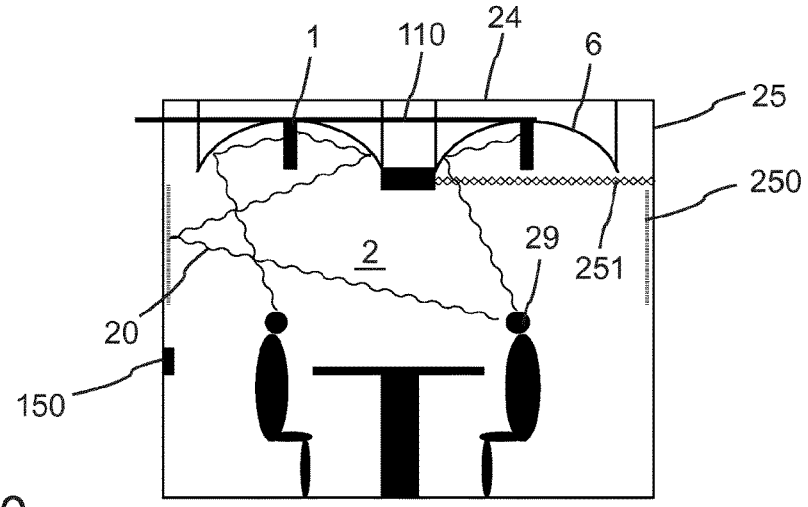
FIG. 20 shows the use of the ninth embodiment of the invention.

FIG. 20 shows the use of the ninth embodiment of the invention. The device 1 with the associated reflector 6 is attached to the ceiling 24. A planar structure 251 can optionally be present to render possible a decorative appearance of the ceiling and hide the reflector 6 from the users.

Heat radiation is either radiated from the heat loads 29 via the reflector 6 to the boundary surfaces of the device 1 directly or after a reflection via an optional infrared reflecting coating 250 on the walls 25. In order to dissipate heat from the heat sinks, a coolant is available which is transported in a ceiling-mounted line 110.

Figure 21:
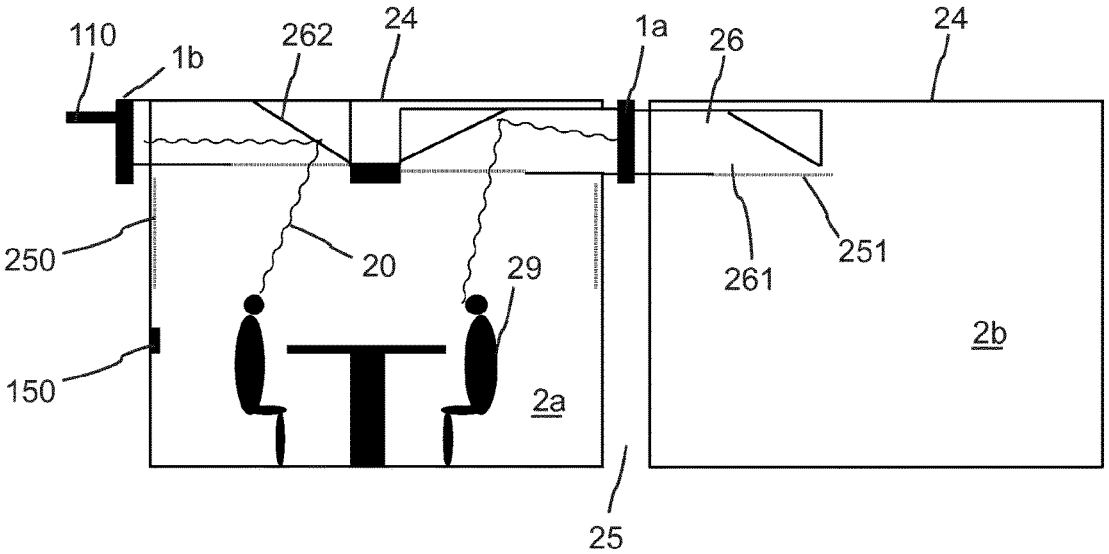
FIG. 21 shows the alternative use of the first or second embodiment of the invention.

FIG. 21 shows a further use of the first or second embodiment of the invention. In the illustrated example of use, it is possible to use either devices 1*a* with boundary surfaces on both sides or devices 1*b* with a boundary surface on only one side.

The devices 1*a* and 1*b* are mounted in a shaft 26, which is opened by an opening 261 towards the room 2*a* and/or towards the room 2*b*. The shaft accommodates reflectors 262, which reflect heat radiation 20 entering through the opening 61 to the boundary surface of the devices 1*a* and/or 1*b*. In order to avoid the contamination and/or render possible a decorative appearance, the openings 261 are closed by an optional planar structure 251. If the device 1*a* is arranged on an inner wall 25 between a room 2*a* and a room 2*b*, it can be used to dissipate heat from the heat loads in the two rooms.

Figure 22:
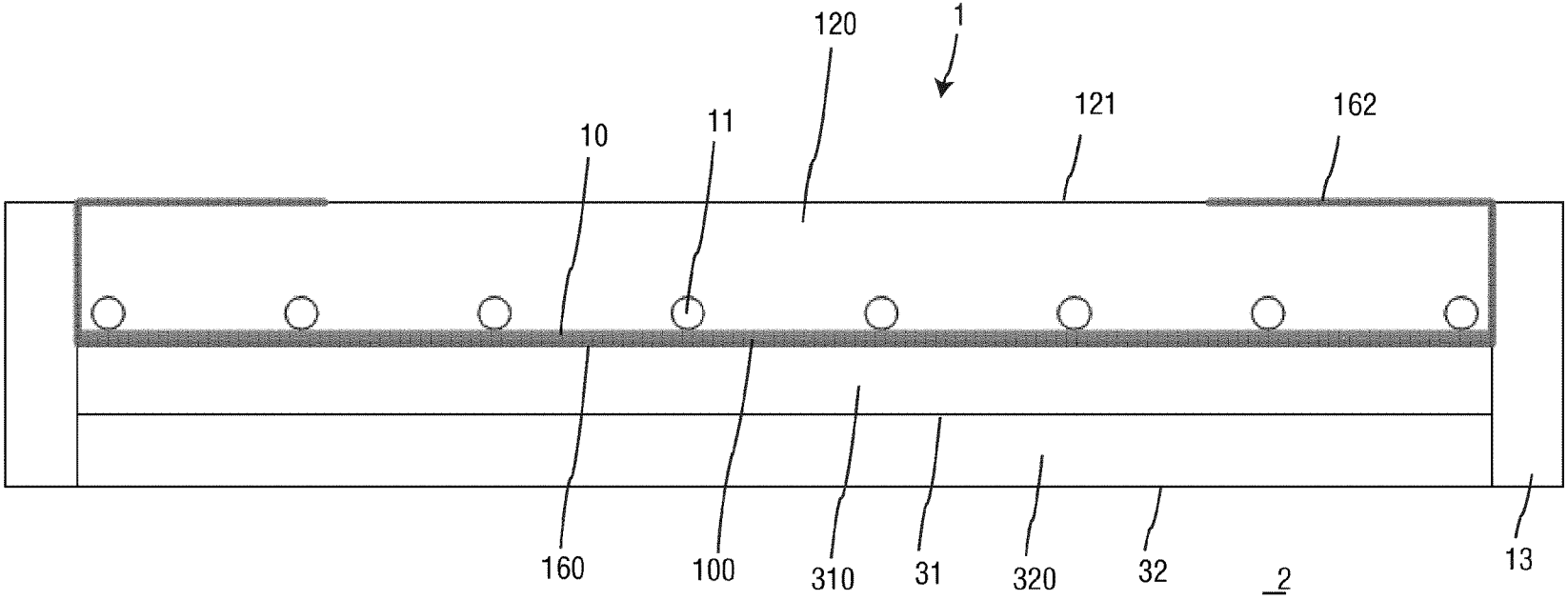
FIG. 22 shows a tenth embodiment of the invention in cross-section.

FIG. 22 shows a tenth embodiment of the invention in cross-section. The following description is limited to the essential differences in relation to the preceding embodiments. In this case, too, the same reference signs designate the same components of the invention.

In the tenth embodiment, the device 1 also contains a heat sink 10 having at least one boundary surface 100, as described above. The surface of the heat sink 10 opposite the boundary surface 100 is provided with a heat insulation 120. The heat insulation 120 can contain or consist of e.g. a rigid foam and/or a mineral wool and/or an organic insulation material.

In order to extract heat from the heat sink 10, the illustrated embodiment has a pipe grid 11, through which e.g. water or another coolant known per se can flow. The pipe grid extracts heat from the heat sink during operation.

The boundary surface 100 faces the room 2 and, as a result, heat radiation from the room 2 can reach the boundary surface 100 where it is absorbed. In order to avoid a direct influence of the room air on the boundary surface 100 and subsequently the precipitation of moisture, the illustrated embodiment has two surface elements 31 and 32. They enclose in each case an intermediate space 310 and 320. The structural elements 31 and 32 are at least partially transparent or translucent in the infrared spectral range of the room temperature radiation, and therefore the heat radiation from the room 2 can penetrate the surface elements 31 and 32 and can be absorbed by the boundary surface 100. This allows the operation of the device which can be designed e.g. as a cooling ceiling or wall element, even at high humidity and a wide temperature spread, without moisture precipitating and subsequently mold becoming a problem or users of the room being inconvenienced. The surface elements 31 and 32 can consist of glass or sintered, IR-transparent materials or plastics, as described above.

FIG. 22 also shows an edge compound 13, which receives the ends of the surface elements 31 and 32 and seals them in approximately gas-tight fashion. Therefore, moisture from the environment cannot penetrate, or can only penetrate to a minor extent, the first intermediate space 310 and the second intermediate space 320 via the edge.

The invention now proposes that the boundary surface 100 be provided with a fleece 160. It can rest on the boundary surface 100 in loose fashion or be attached to the boundary surface, e.g. by bonding. As is also clear from FIG. 22, the fleece 160 extends over the edge compound 13 up to the rear side 121 of the heat insulation 120. On the rear side 121 of the heat insulation 120, the fleece 160 can be attached over the entire area or can only cover a partial area 162, as shown in the figure.

If during the operation of the device 1 undesired moisture penetrates the intermediate space 310 and condenses on the boundary surface 100, this moisture is removed from the intermediate space 310 by the capillary attractive forces forming in the fleece so as to avoid problems caused by condensing moisture.

The cause for the suction of the fleece 160 is the surface tension of the liquid and the wettability of the pore surfaces inside the fleece 160. A capillary effect will occur when the adhesive forces from liquid to solid material are stronger than the molecular adhesive forces of the fluid. In spite of the complex pore structures, the capillary effect can be described well, even though in a very simplified way, by means of the model of the cylinder capillaries. The liquid in the pore is accelerated by the capillary attractive forces. The flow resistance acts in the opposite direction. However, gravitation has an influence on the fluid transport when the pore radii are greater than 6 μm. The cylinder capillary model divides the capillary effect into two time phases: suction and further distribution. When in contact with liquid water, the larger pores of the fleece suck water into the interior of the fleece. The size limit of the pore radius is here the equilibrium of forces between flow resistance and capillary attractive forces. In this connection, the flow resistance is proportional to the reciprocal value of the pore radius to the square, and the attractive force is proportional to the reciprocal value of the radius. The second phase is the further distribution following the interruption of the water supply. The not yet filled, small pores suck the larger pores empty. In so doing, the water content in the front part drops. Therefore, the fleece absorbs the moisture in the interior of the panel and distributes it over the entire fleece and beyond the edge compound to the outer side 121 of the heat insulation 120. However, if colder temperatures prevail on one side of the fleece, the liquid is transported towards the warmer side. A driving potential is here the relative humidity which is lower on the warm side, i.e. on the outer side 121 of the heat insulation, than on the cold side, i.e. the boundary surface 100.

In this way, the intermediate space 310 can be kept constantly dry in an easy way and without any moving parts to ensure a long and undisturbed operation of the device.

Of course, the invention is not limited to the embodiment illustrated in the drawings. Therefore, the above description should not be considered limiting but explanatory. The below claims should be interpreted to mean that a feature mentioned is present in at least one embodiment of the invention. This does not exclude the presence of further features. If the claims and the above description define "first" and "second" embodiments, this designation serves to distinguish between two equal embodiments without determining an order. Features from different embodiments of the invention can be combined at any time to obtain further embodiments of the invention.

The invention claimed is:

1. A device comprising at least one heat sink having at least one boundary surface facing a room, said boundary surface configured to have a temperature being lower than a thermal load inside said room, wherein at least one panel element is arranged between the boundary surface and the room, said panel element being at least partially permeable to heat radiation, wherein the panel element is spaced apart from the boundary surface, thereby forming a gap between the panel element and the boundary surface and the at least one panel element and the heat sink are surrounded by an edge compound, which is configured to seal the gap against the surroundings, wherein said device further comprises at least one dehumidifying apparatus being configured to expel water from the gap between the panel element and the boundary surface, wherein the boundary surface is at least partially covered with a non-woven fabric, and wherein the non-woven fabric extends beyond the edge compound to the rear side of a heat insulation arranged adjacent to said heat sink and on the opposite side of said boundary surface facing the room.

2. The device according to claim 1, wherein the panel element has an optical transmission of more than about 50% or more than about 70% or more than about 80% at at least one wavelength being selected from an interval between about 3 μm and about 30 μm or between about 6 μm and about 20 μm.

3. The device according to claim 1, wherein the heat sink comprises any of a pipe register and a plate heat exchanger.

4. The device according to claim 1, comprising further an apparatus being configured to fill the gap with a protective gas or being configured to evacuate the gap.

5. The device according to claim 1, wherein said dehumidifying apparatus comprises any of at least one sorbent and at least one micro-pump and at least one heating apparatus and at least one valve and at least one fan and a porous material and a non-woven fabric.

6. The device according to claim 1, wherein the at least one panel element comprises at least one polymer.

7. The device according to claim 6, wherein the at least one polymer is selected from any of polyethylene and polymethyl metacrylate and polyvinyl chloride and polypropylene and polyethylene terephthalate and polyester and cellulose acetate butyrate and cellulose acetate.

8. The device according to claim 1, wherein the edge compound comprises at least one sealing element, comprising any of polyisobutylene and silicone and butyl rubber.

9. The device according to claim 1, wherein the edge compound is obtainable by forming a weld between the at least one panel element and the heat sink.

10. The device according to claim 1, wherein the edge compound has at least one magnetic or mechanical lock being configured to couple the at least one panel element and the heat sink.

11. The device according to claim 1, comprising further at least one reflector being configured to guide heat radiation emerging from the thermal load onto at least one boundary surface.

12. A method for air-conditioning a room, the method comprising:

providing at least one heat sink having at least one boundary surface facing the room;

bringing said boundary surface to a temperature that is lower than a temperature of at least one thermal load;

arranging at least one panel element between the boundary surface and the room, said panel element being at least partially permeable to heat radiation and forming a gap between said panel element and said boundary surface; and removing humidity from said gap by means of a dehumidifying apparatus, wherein said dehumidifying apparatus comprises at least one non-woven fabric covering said boundary surface at least partially, wherein the non-woven fabric extends to the rear side of a heat insulation arranged adjacent to said heat sink and on the opposite side of said boundary surface.

13. The method according to claim 12, wherein the panel element has an optical transmission of more than about 50% or more than about 70% or more than about 80% at at least one wavelength being selected from an interval between about 3 μm and about 30 μm or between about 6 μm and about 20 μm.

14. The method according to claim 12, wherein said gap is filled with a protective gas or said gap is evacuated.

15. The method according to claim 12, wherein said dehumidifying apparatus comprises any of at least one sorbent and at least one micro-pump and at least one heating apparatus and a gas flow (39).

16. The method according to claim 12, wherein heat radiation emerging from the thermal load is guided by means of at least one reflector onto at least one boundary surface.

* * * * *